US006086451A

United States Patent [19]

Fernandes

[11] Patent Number: 6,086,451

[45] Date of Patent: Jul. 11, 2000

[54] DECORATIVE BRASSIERE SHOULDER STRAP

[76] Inventor: Marcia Fernandes, 2148 W. Maya Palm Dr., Boca Raton, Fla. 33432

[21] Appl. No.: 09/415,241

[22] Filed: Oct. 12, 1999

[51] Int. Cl.[7] ..... A41C 3/00

[52] U.S. Cl. ..... 450/86; 450/1; 450/88; 2/67; D2/700

[58] Field of Search ..... 450/86, 1, 88; 2/67; D2/700, 701, 703, 706, 708, 731, 734, 793

[56] References Cited

U.S. PATENT DOCUMENTS

D. 278,473 4/1985 Briggery-Myles ..... D2/706

*Primary Examiner*—Gloria M. Hale
*Attorney, Agent, or Firm*—Myron Amer PC

[57] ABSTRACT

An exposed strap of a brassiere embodying decoration, in a preferred embodiment, as interconnected chain links, in which the looseness of the links permits the strap to assume a looping shape over a user's shoulder, during fitting of the brassiere, and thereafter an elastic tab holds the strap taut during use.

1 Claim, 1 Drawing Sheet

DECORATIVE BRASSIERE SHOULDER STRAP

The present invention relates generally to improvements in the construction of a brassiere ("bra"), the improvements more particularly contributing significantly not only to the comfort in the wearing of the bra but, even more importantly, contributing to providing a significantly enhanced fashionable appearance to the bra when worn.

EXAMPLES OF THE PRIOR ART

Structural features have been used to effect the positioning of components of a bra, as exemplified by U.S. Pat. No. 1,824,613 issued to Middleton on Sep. 22, 1931, in which use is made of "hooks" and "eyes" selectively interconnected to control the size of separation between the cups, either spread apart or closed. The controlled adjacent cups' position is in the view of an observer, and thus is observed, but it does not significantly contribute to a noteworthy appearance being presented to the viewer, but rather has as its object to achieve greater comfort in the wearing of the bra.

In U.S. Pat. No. 3,633,075 issued to Gluckin et al. on Apr. 4, 1972, the shoulder straps of the bra are constructed to exhibit stretchability, thus representing another effort to make wearing the bra more comfortable, but not necessarily improving what a viewer sees when observing the bra when worn.

Broadly, it is an object of the present invention to provide a bra which is embodied with structural features overcoming the foregoing and other shortcomings of the lacking of fashionable appearance attributes of the prior art.

More particularly, it is an object to use to advantage the happenstance that shoulder straps of bras worn beneath low neckline garments are prominently displayed, and to effectively apply decoration to these exposed bra straps without detracting from comfort, all as will be better understood as the description proceeds.

The description of the invention which follows, together with the accompanying drawings should not be construed as limiting the invention to the example shown and described, because those skilled in the art to which this invention appertains will be able to devise other forms thereof within the ambit of the appended claims.

Figure 1:
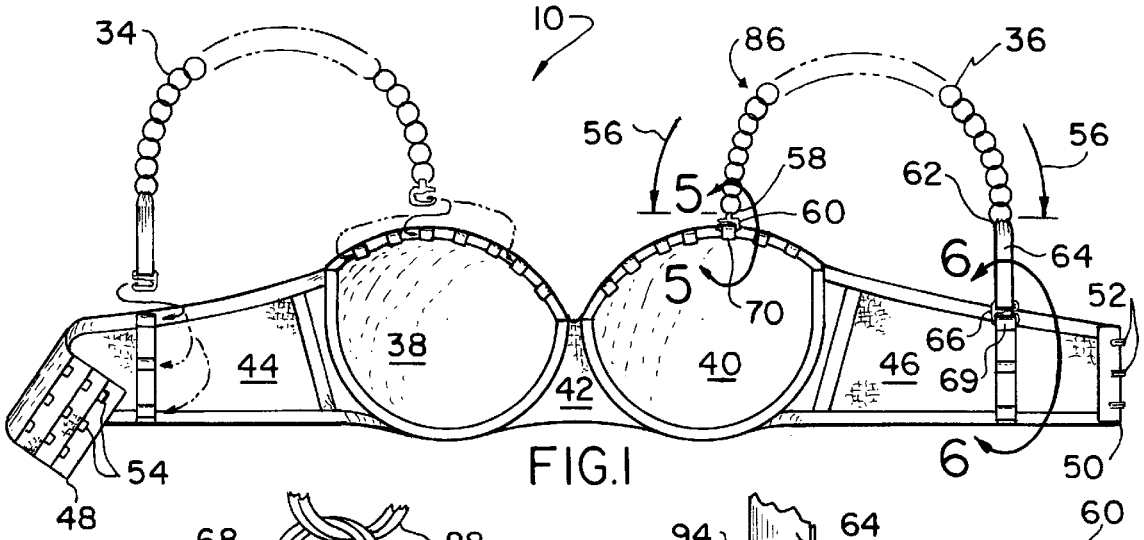
FIG. 1 is a front elevational view, as seen from the rear, of a bra constructed and adapted to be worn in accordance with the present invention.
Figure 3:
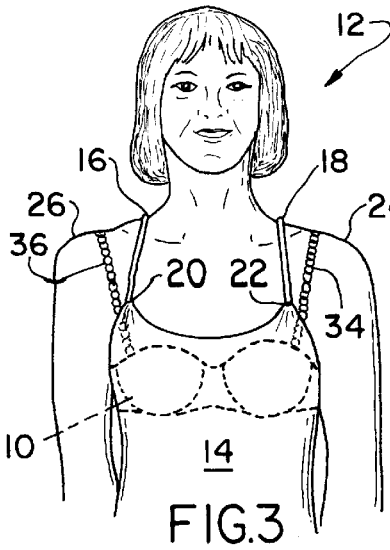
FIG. 3 is another front elevational view of the bra of FIG. 1, but as seen from the front and as worn by a user.
Figure 4:
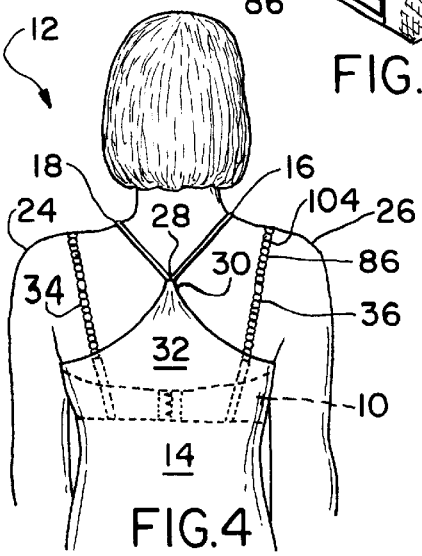
FIG. 4 is a view similar to FIG. 3, but as seen from the rear.

Shown in FIG. 1 is a brassiere, or bra, generally designated 10, which has the significantly enhanced fashionable appearance illustrated in FIGS. 3 and 4, in which as seen from the front (FIG. 3), consists of the user 12 having a low cut upper torso garment 14 either without shoulder straps (not shown) or with, in fashion parlance, having so-called spaghetti strap clothing which is embodied with thin shoulder straps 16 and 18 connected to extend from front attachment sites 20 and 22 and extend over the left 24 and right 26 shoulders to a common attachment site 28 at the top 30 of the rear 32 of the garment 14. Providing the enhanced fashionable appearance are, in accordance with the present invention, exposed decorative bra straps 34 and 36, the decorative attribute of which will be more particularly described and better understood as the description proceeds.

Constructionwise, the bra 10 has left and right breast-covering cups 38 and 40 sewn in a conventional manner to a front panel 42 and has side straps 44 and 46 sewn to extend from the front panel 42 rearwardly for attachment of cooperating opposite ends 48 and 50 to each other using hooks 52 and eyes 54 interconnecting structure, so as to hold the cups 38 and 40 in their covering relation over the wearer's breast, as illustrated in FIGS. 3, 4.

Figure 5:
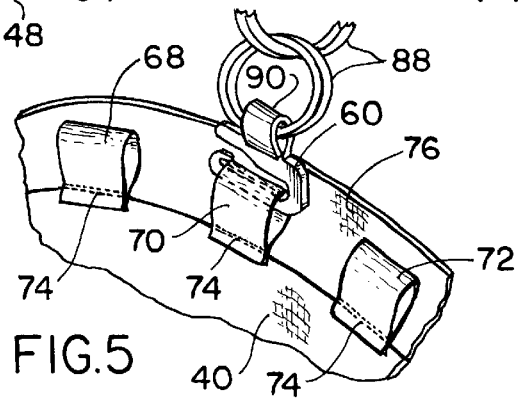
FIG. 5 is a detail perspective view of a shoulder strap connection as outlined by arrows 5—5 applied to FIG. 1.
Figure 6:
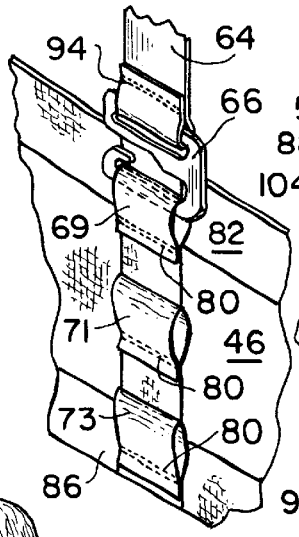
FIG. 6 is another detail perspective view, but of another shoulder strap connection and as outlined by arrows (6—6 applied to FIG. 1.

Each bra strap, taking strap 36 as an example, has a selected decorative appearance primarily as a result of its construction material and physical attributes as now to be specifically noted, and located along its length, denoted by the arrow 56 of FIG. 1. At one end, in this illustrated instance being preferable the front end 58, each strap has a hook 60 and at its rear positioned end 62 an elastic loop or tab 64 also having a hook 66. As respectively shown in FIGS. 5 and 6, the front hook 60 can be, attached to a selected one of three horizontally oriented loops 68, 70, and 72 stitched, as at 74, to a binding 76 along the top of cup 40, and rear hook 66 to one of three vertically oriented loops 69, 71 and 73 stitched, as at 80, to extend between bindings 82 and 84 of a side strap 46. The selection of which hooks 60, 62 are to be connected to which loops 68, 70, 72 and 69, 71, 73 is at the option cf the user 12, and most likely would factor in that spaghetti straps on clothing, as exemplified by straps 16 and 18, can situate themselves very close to the user's neck to very wide on the shoulder, and thus by the hook and loop selection there can be achieved the flexibility to align or intentionally not to align the clothing straps 16 and 18 and the bra straps 34 and 36.

Figure 2:
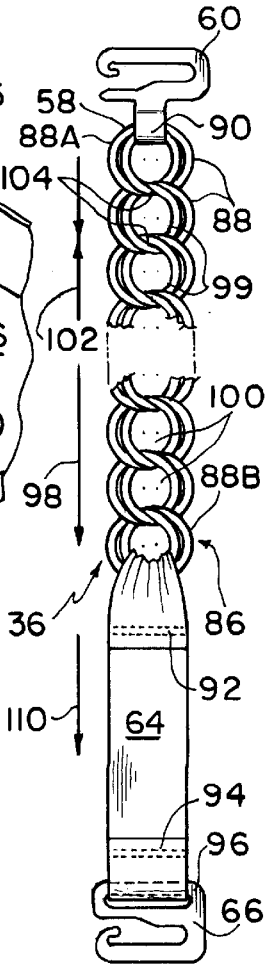
FIG. 2 is a detail view of a double link chain version of a shoulder strap adapted for use with the bra of FIG. 1.

For each bra strap 34, 36 having an embodied noteworthy decorative appearance, a wide range of construction materials are appropriate for use, such as a string of pearls, silver rope, interconnected or linked together shapes set with costume jewelry, and, selected for illustration and description herein, double link gold chain 86, shown generally in FIG. 1 and in greater detail and in significantly enlarged scale in FIG. 2. More particularly, as illustrated in FIG. 2, chain 86 consists of a series of interconnected double links, individually and collectively designated 88, in which one end double link 88A is engaged to a loop, as at 90, to front hook 60, and an opposite end double link 88B has looped through it a length of elastic, constituting the previously noted elastic tab 64, stitched, as at 92, to secure its looped attachment to double link 88B, and stitched, as at 94, to secure its looped attachment to a leg 96 of the rear hook 66. The double link chain 86 is, as is well understood, not elastic or stretchable in a lengthwise direction 98, but, by virtue of the openings bounded by the link surfaces 99, aptly characterized as clearances in the double links 88, and which clearances are individually and collectively designated 100, are contractible in a lengthwise direction 102. In practice, the contractible movement 102 could cause pinching discomfort to the user 12 at the interface, as at 104, of the chain 86 with the shoulder 26 of the user 12. The clearances 100 however which could result in this discomfort must be embodied in the bra strap 36 in order that the bra strap 36 can assume a necessary looped configuration, as illustrated in FIGS. 3, 4, conforming to the natural shape or configuration of the shoulders 24, 26.

To obviate this adverse consequence of the looseness or clearances 100 of the decorative construction materials of the bra strap 36 is the functioning of the elastic tab 64, in that in the fitting of the bra 10 on the wearer 12 the bra strap 36 being slightly undersized in relation to the size of the wearer's shoulder stretches the tab 64 and causes an urgency in an opposite direction 110 which holds the chain 86 taut and in this manner obviates any localized closing movement 102 in the chain double links 88. The positioning of the bra 10 using the interconnected side straps 44, 46 also establishes the horizontal position thereof and this contributes to achieving the size differences in the superposed looping configurature of the bra strap 36 and the underlying supporting configuration of the shoulder 26, so as to produce the noted urgency in the direction 110 in the tab 64.

While the apparatus for practicing the within inventive method, as well as said method herein shown and disclosed in detail is fully capable of attaining the objects and providing the advantages hereinbefore stated, it is to be understood that it is merely illustrative of the presently preferred embodiment of the invention and that no limitations are intended to the detail of construction or design herein shown other than as defined in the appended claims.

What is claimed is:

1. An exposed decorative shoulder strap for a brassiere comprising a brassiere body having front bra cups and opposite side straps extending rearwardly for attachment to each other adjacent a back of a wearer so as to position said bra cups in covering relation over a wearer's breasts, aligned individual decorative objects serving as a shoulder strap with interconnecting means having a degree of looseness of an extent to allow an assumption of a shape conforming to a shape of a shoulder of a wearer, a tab of elastic construction material attached to an end of said shoulder strap, an operative position of said shoulder strap extending in spanning relation between sites of attachment to a rear and front of said brassiere and looped over a wearer's shoulder, and an urgency in said elastic tab holding apart said decorative objects to the extent permitted by said looseness of said interconnecting means, whereby during wear there is no closing movement of adjacent decorative objects as might cause pinching discomfort.

* * * * *